US011583069B2

(12) United States Patent
Kiesow

(10) Patent No.: US 11,583,069 B2
(45) Date of Patent: Feb. 21, 2023

(54) FOLDING TABLE AND ASSOCIATED FOLDING MECHANISMS

(71) Applicant: NPS Public Furniture Corp., Clifton, NJ (US)

(72) Inventor: Charles P. Kiesow, Denville, NJ (US)

(73) Assignee: NPS Public Furniture Corp., Clifton, NJ (US)

( * ) Notice: Subject to any disclaimer, the term of this patent is extended or adjusted under 35 U.S.C. 154(b) by 15 days.

(21) Appl. No.: 17/225,318

(22) Filed: Apr. 8, 2021

(65) Prior Publication Data

US 2022/0322818 A1 Oct. 13, 2022

(51) Int. Cl.
*A47B 3/14* (2006.01)
*A47B 3/06* (2006.01)

(52) U.S. Cl.
CPC ..... *A47B 3/14* (2013.01); *A47B 3/063* (2017.08); *A47B 2003/145* (2013.01)

(58) Field of Classification Search
CPC ..... A47B 3/14; A47B 3/063; A47B 2003/145
USPC ..... 297/158.4
See application file for complete search history.

(56) References Cited

U.S. PATENT DOCUMENTS 4,120,249 A * 10/1978 Blink ..... A47B 3/087 108/174
6,065,802 A * 5/2000 Bue ..... A47B 3/14 297/170
6,223,661 B1 * 5/2001 Griepentrog ..... A47B 3/14 108/115
7,758,113 B2 * 7/2010 Hanusiak ..... A47C 9/10 297/157.1
8,181,583 B2 * 5/2012 Rivera, Jr. ..... A47B 3/083 108/169
2005/0161984 A1 * 7/2005 Bue ..... A47B 3/14 297/157.1
2008/0116724 A1 * 5/2008 Dickey ..... A47B 3/14 297/159.1
2012/0013152 A1 * 1/2012 Bradley ..... A47C 9/022 297/135
2017/0245632 A1 * 8/2017 Dickey ..... A47B 3/14

* cited by examiner

*Primary Examiner* — Daniel J Troy
*Assistant Examiner* — Timothy M Ayres
(74) *Attorney, Agent, or Firm* — Weiss & Arons LLP

(57) ABSTRACT

A modular apron assembly for use in a folding mechanism is provided. The apron assembly may include a cross bar and four perpendicular bars. The perpendicular bars may be affixed to the cross bar and oriented substantially perpendicular to the cross bar. Two of the perpendicular bars may include a leg mount. A coupling flange may extend from each end of the cross bar. Each coupling flange may define a coupling hole for connecting to the coupling holes of an opposing apron assembly. An elbow flange may extend from the cross bar and define a mounting hole. The distance between the mounting hole and the coupling holes may be less than 40 millimeters, the distance between the coupling holes and the leg mounts may be more than 69 millimeters, and the distance between the coupling holes and the leg mounts may be less than 120 millimeters.

20 Claims, 13 Drawing Sheets

FOLDING TABLE AND ASSOCIATED FOLDING MECHANISMS

FIELD OF TECHNOLOGY

Aspects of the disclosure relate to functional mechanical designs and apparatus. Specifically, aspects of the disclosure relate to folding tables with improved utility and performance.

BACKGROUND OF THE DISCLOSURE

Functional furniture plays an important role in everyday activities. Exemplary activities may relate to the workplace, the home, retail locations, office settings, educational locations, eateries, leisure, and any other activity that may utilize furniture such as a table.

Folding features may increase the utility of functional furniture such as a table. A folding table may be easily stowed away in a much smaller space than is occupied by the table when unfolded. Many conventional folding tables, however, require significant force input to fold and/or unfold the table. Reducing the force input required to fold and/or unfold the table is often associated with reduced structural strength and/or performance of the table.

It would be desirable, therefore, to provide systems and methods for folding tables (or other folding furniture or surfaces), with reduced force input requirements for folding and/or unfolding the table. It would be further desirable for the folding tables to be associated with high structural strength and performance.

SUMMARY OF THE DISCLOSURE

Aspects of the disclosure relate to a folding surface, and/or associated support mechanisms. A support mechanism may support the surface and facilitate folding of the surface. The surface may include a first portion and a second portion.

The support mechanism may include a first apron assembly affixed to a bottom surface of the first portion of the surface. The support mechanism may also include an opposing second apron assembly affixed to a bottom surface of the second portion of the surface. Each apron assembly may define an x-axis, a y-axis, and a z-axis.

Each apron assembly may include a cross bar disposed along the z-axis and four perpendicular bars disposed along the x-axis. The four perpendicular bars may be affixed to the cross bar and oriented substantially perpendicular to the cross bar. Each of an inner two of the four perpendicular bars may include an inward-facing leg mount.

Each apron assembly may include a coupling flange that extends, along the x- and the y-axes, from each end of the cross bar. Each coupling flange may define a coupling hole for connecting to the coupling holes defined by the coupling flanges of the opposing apron assembly.

Each apron assembly may include an elbow flange that extends, along the x- and the y-axes, from the cross bar. The elbow flange may define a mounting hole.

The support mechanism may include a first leg assembly that is affixed to each of the leg mounts of the first apron assembly, and a second leg assembly that is affixed to each of the leg mounts of the second apron assembly.

The support mechanism may include a first folding arm that is affixed to the mounting hole of the first apron assembly and to the second leg assembly, and a second folding arm that is affixed to the mounting hole of the second apron assembly and to the first leg assembly.

In a preferred embodiment, the distance in each apron assembly along the y-axis between the mounting hole and the coupling holes may be less than 40 millimeters, the distance in each apron assembly along the y-axis between the coupling holes and the leg mounts may be more than 69 millimeters, and the distance in each apron assembly along the x-axis between the coupling holes and the leg mounts may be less than 120 millimeters.

In operation, application of a first force when the surface is in an unfolded, or deployed, position may convert the surface into a folded position. Application of a second force when the surface is in the folded, or undeployed, position may convert the surface into the unfolded, or deployed, position.

BRIEF DESCRIPTION OF THE DRAWINGS

The objects and advantages of the disclosure will be apparent upon consideration of the following detailed description, taken in conjunction with the accompanying drawings, in which like reference characters refer to like parts throughout, and in which.

DETAILED DESCRIPTION OF THE DISCLOSURE

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is understood that other embodiments may be utilized, and that structural, functional, and procedural modifications may be made without departing from the scope and spirit of the present disclosure.

Aspects of the disclosure relate to a folding surface and/or associated support mechanisms. A support mechanism may support the surface and facilitate folding of the surface. The surface may include a tabletop. The tabletop may be part of a table. The surface may include a first portion and a second portion.

Figure 1A:
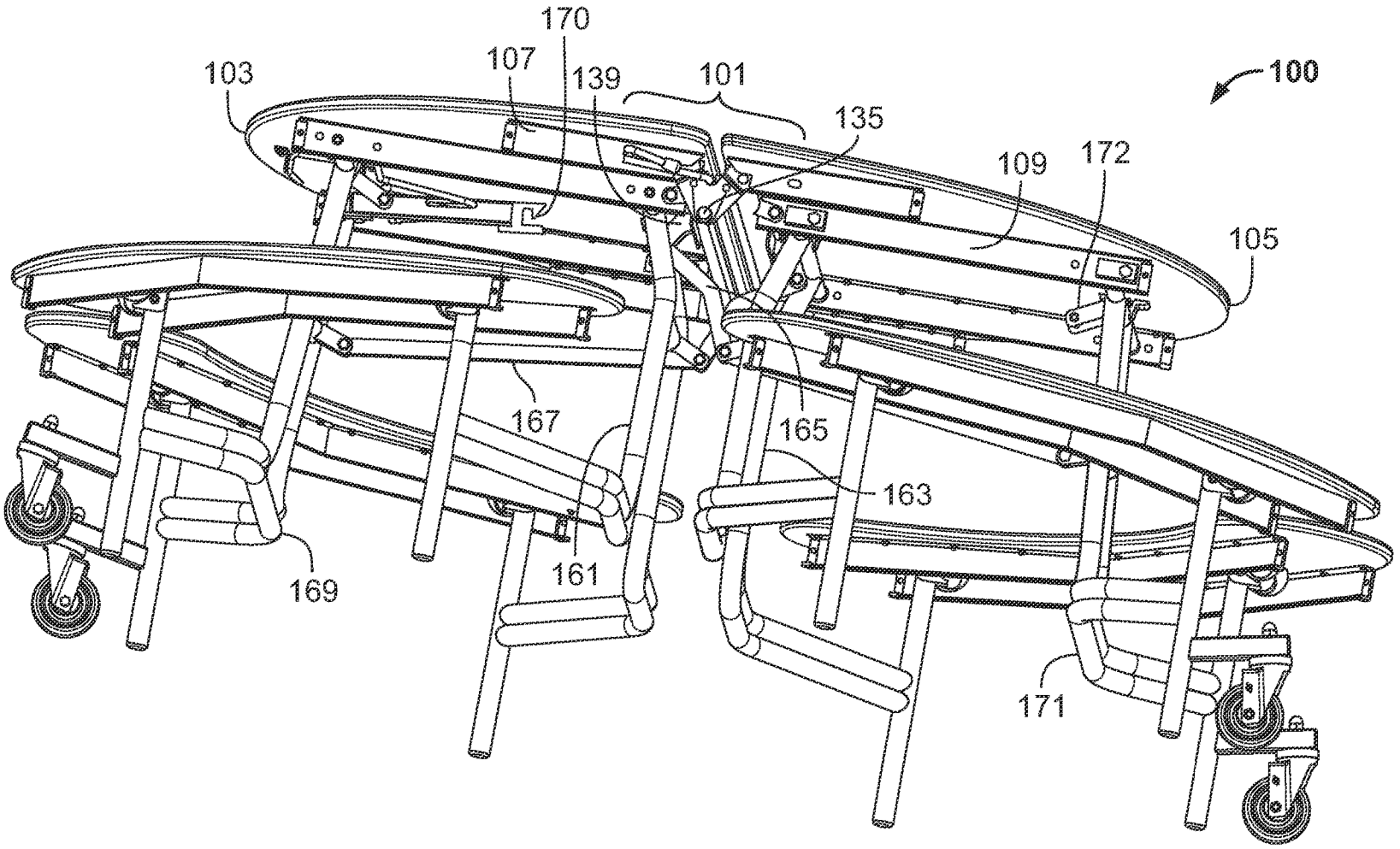
FIGS. 1A-1B show an illustrative apparatus in accordance with principles of the disclosure.
Figure 1B:
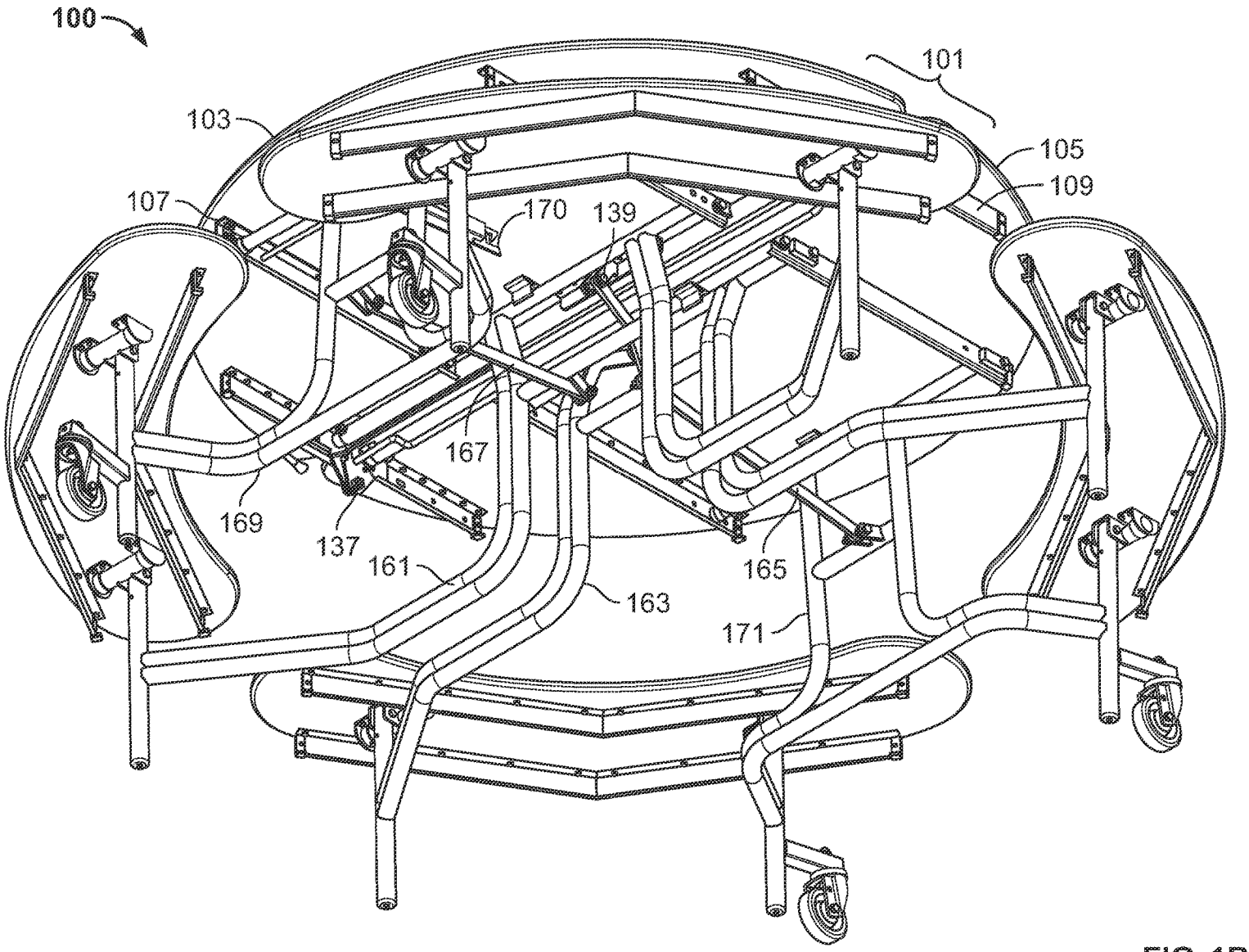
Figure 2B:
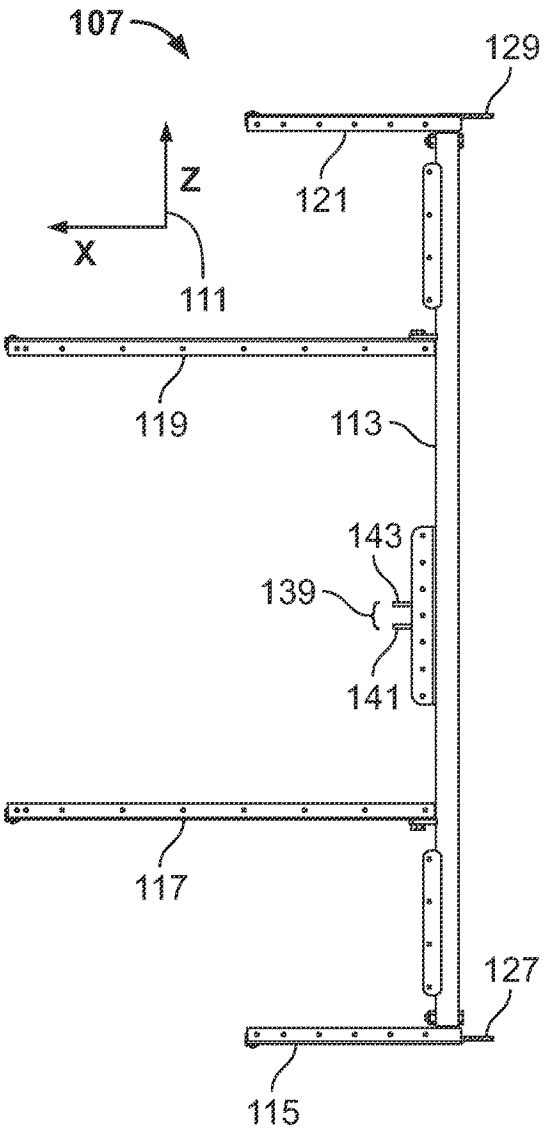
FIGS. 2A-2D show another illustrative apparatus in accordance with principles of the disclosure.
Figure 2A:
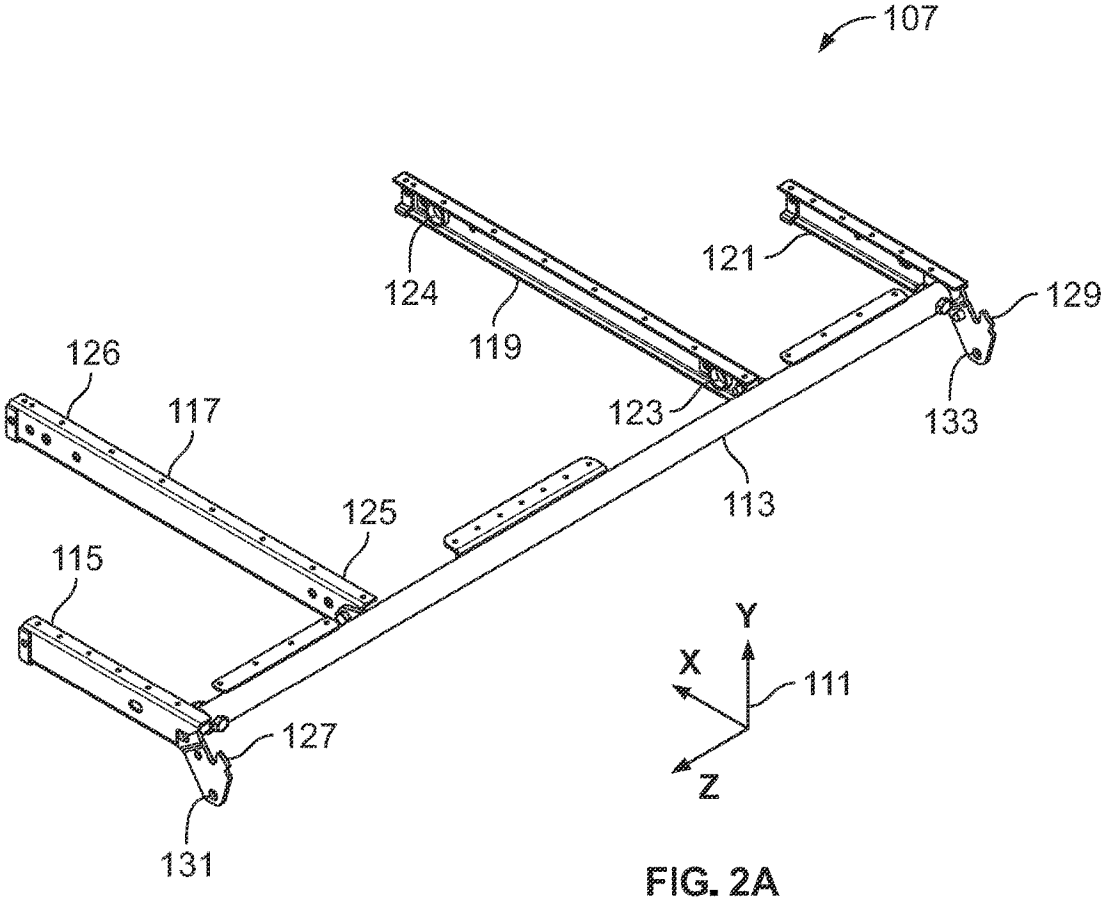
Figure 2C:
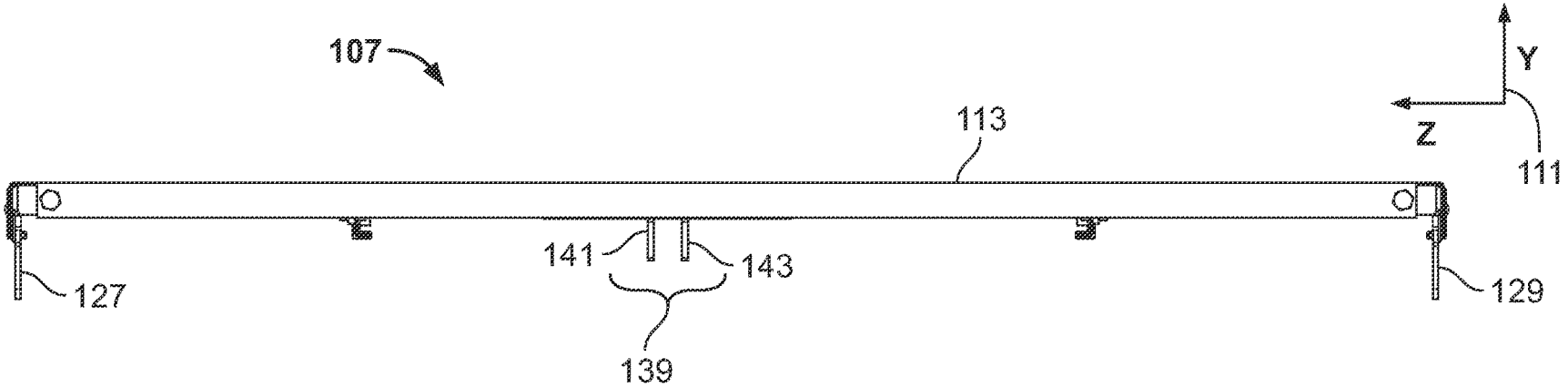
Figure 2D:
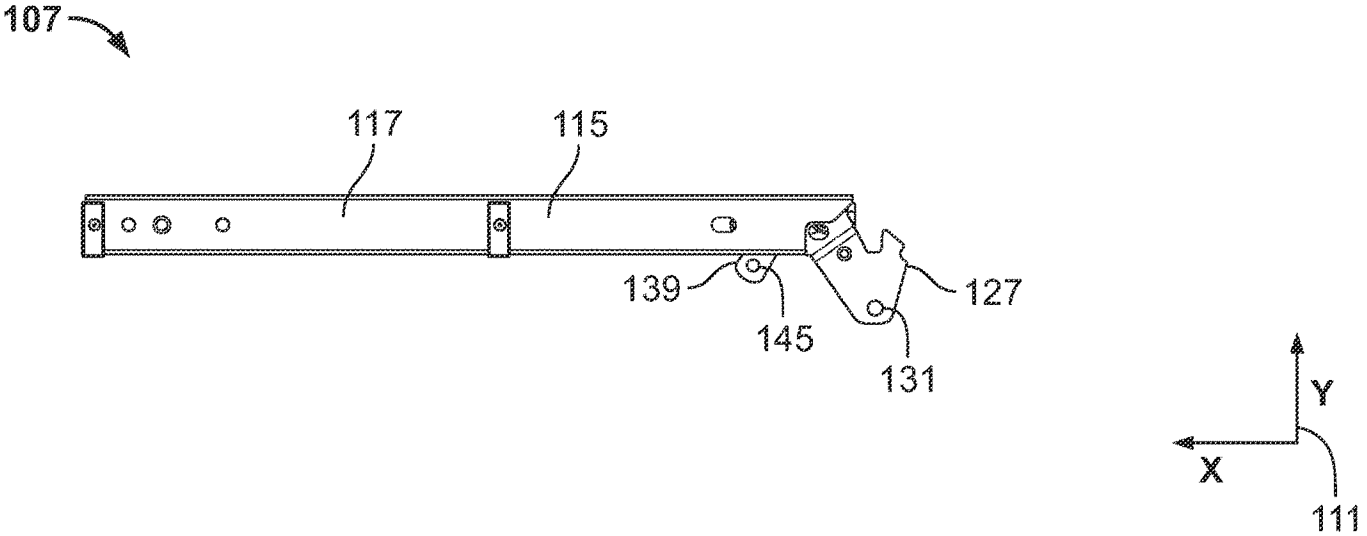
Figure 3A:
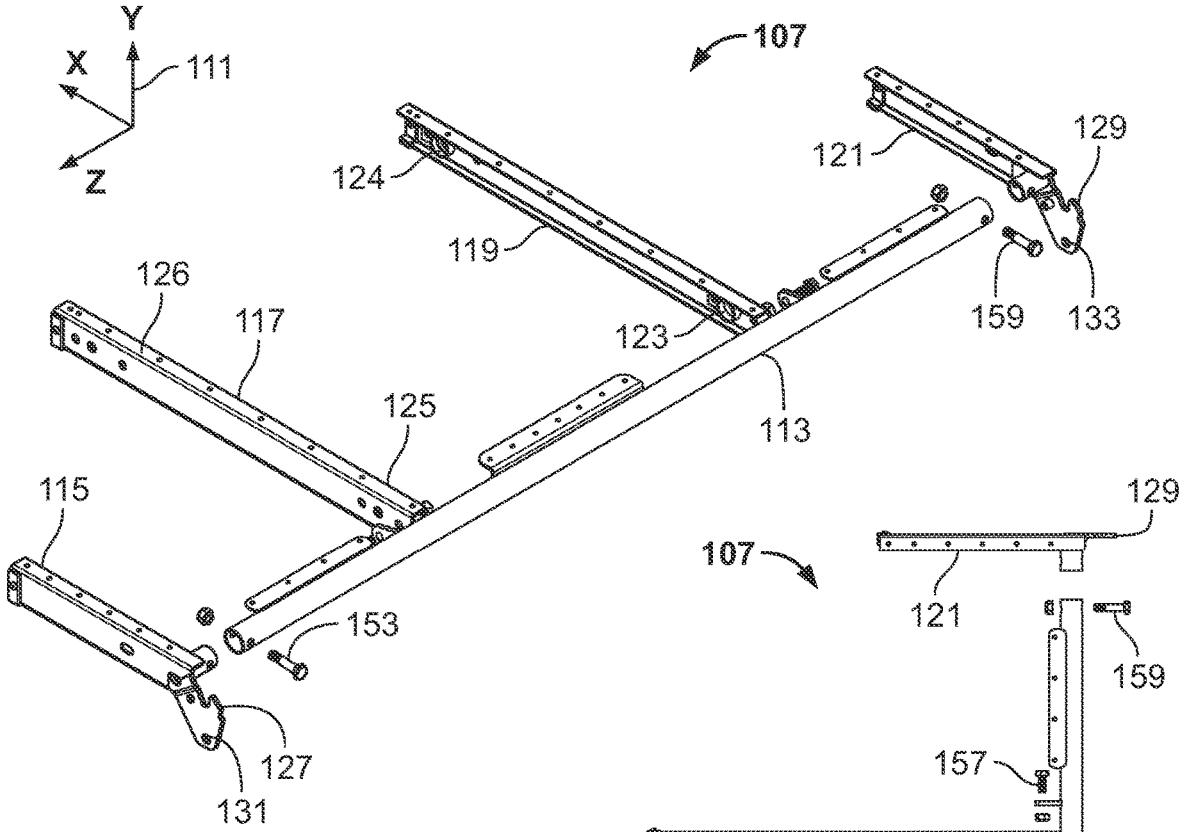
FIGS. 3A-3D show another illustrative apparatus in accordance with principles of the disclosure.
Figure 3B:
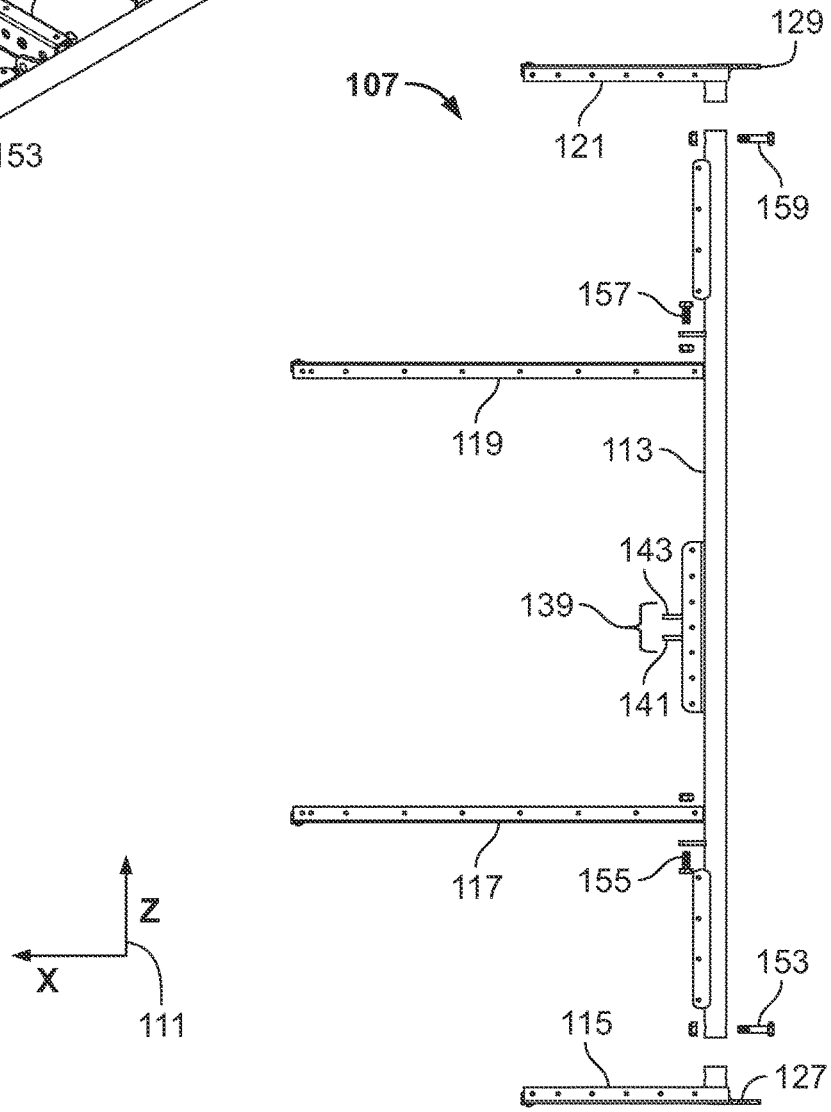
Figure 3C:
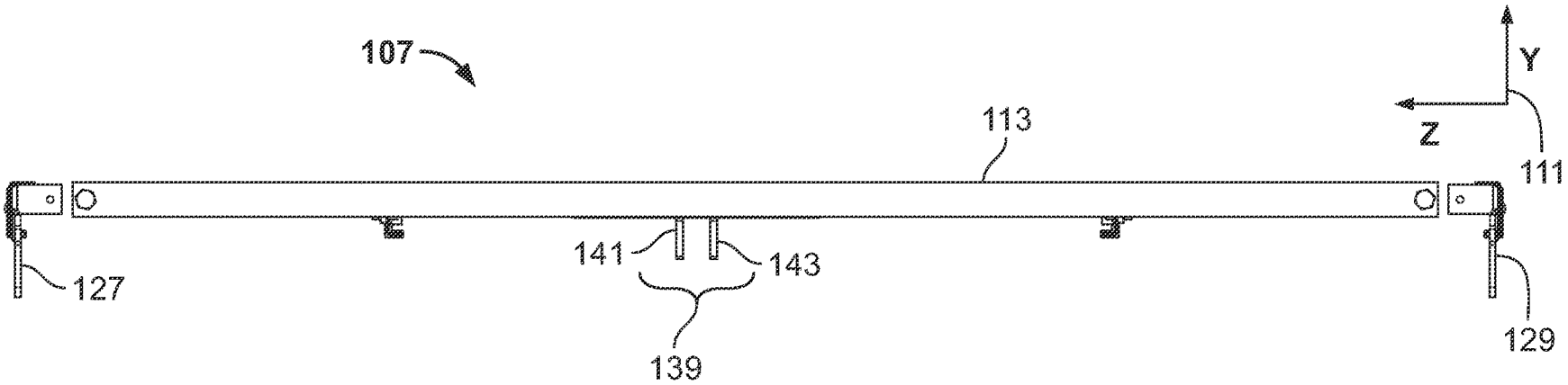
Figure 3D:
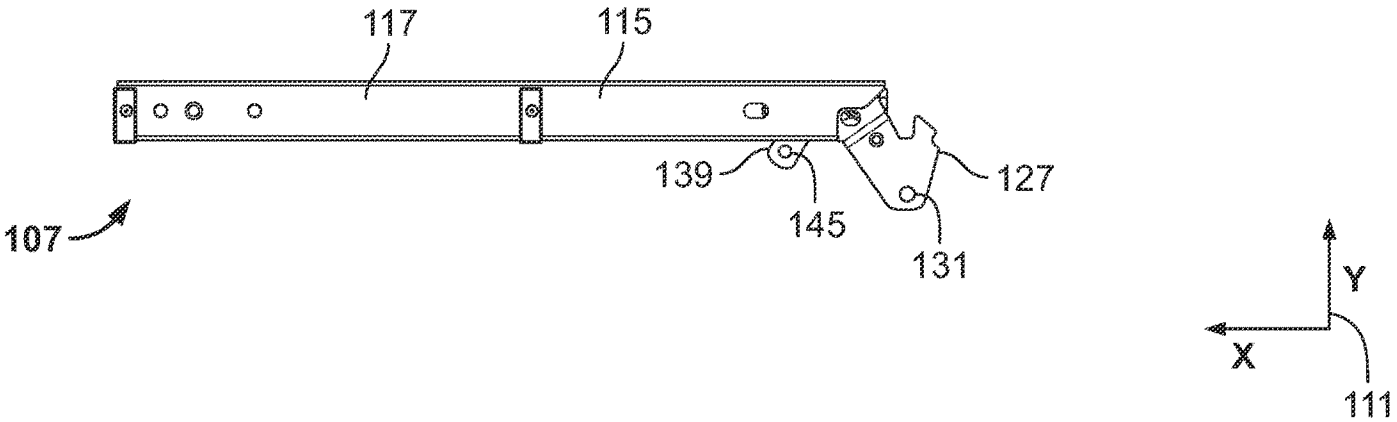

FIGS. 1A and 1B show different views of illustrative folding table 100. Table 100 includes tabletop 101. Tabletop 101 includes first portion 103 and second portion 105.

The support mechanism may include a first apron assembly (e.g., apron assembly 107 in FIGS. 1A and 1B) affixed to a bottom surface of the first portion of the surface. The support mechanism may also include an opposing second apron assembly (e.g., apron assembly 109 in FIGS. 1A and 1B) affixed to a bottom surface of the second portion of the surface.

Figure 4:
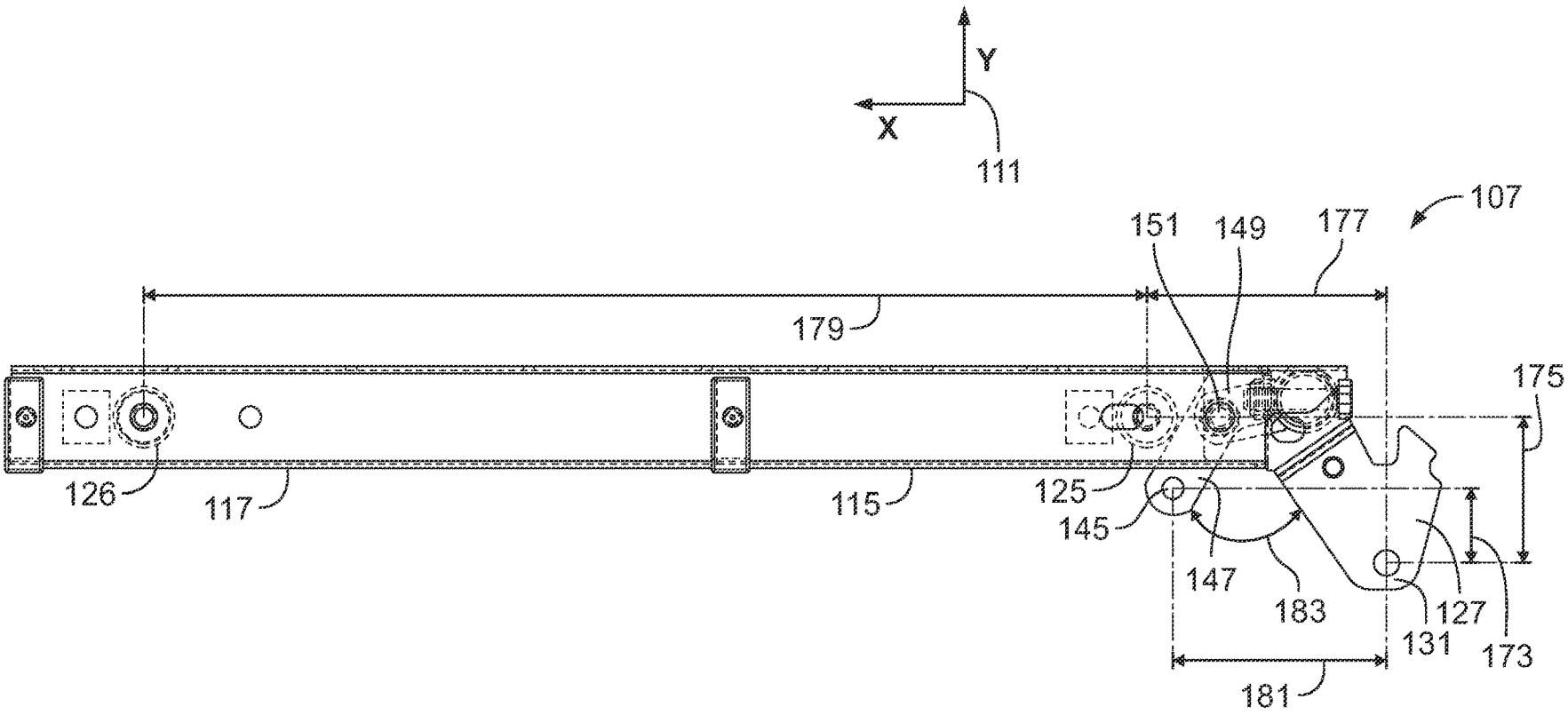
FIG. 4 shows another illustrative apparatus in accordance with principles of the disclosure.

FIGS. 2A-D show different views of an illustrative individual apron assembly (e.g., apron assembly 107). FIGS. 3A-D show corresponding, exploded, views of the apron assembly shown in FIGS. 2A-D. Each apron assembly may define an x-axis, a y-axis, and a z-axis. (See, e.g., illustrative axes 111.) FIG. 4 shows another view of an illustrative apron assembly such as the apron assembly shown in FIGS. 2A-D.

Each apron assembly may include a cross bar (e.g., cross bar 113) disposed along the z-axis. Each apron assembly may also include four perpendicular bars (e.g., bars 115, 117, 119, and 121) disposed along the x-axis. The four perpendicular bars may be affixed to the cross bar and oriented substantially perpendicular to the cross bar. Each of an inner two (e.g., bars 117 and 119) of the four perpendicular bars may include an inward-facing leg mount, e.g., mounts 123 and 125. Inward facing refers to the direction towards the region between the inner two bars. Mount 125 may be partially hidden in the views in FIGS. 2A-D and FIGS. 3A-D due to the angles of the views. Mount 125 may substantially mirror mount 123.

In certain embodiments, the inner two of the four perpendicular bars may be a first length and the outer two of the four perpendicular bars may be a second length. The first length may be longer than the second length. In some embodiments, the first length may be substantially 600 millimeters and the second length may be substantially 300 millimeters. (For the purposes of the application, the term "substantially," as used to describe a value, may be understood to refer to +/−0.5% of the value.) In other embodiments, the first length may be in the range between 550 and 650 millimeters and the second length may be in the range between 250 and 350 millimeters.

Each apron assembly may include a coupling flange (e.g., flanges 127 and 129) that extends, along the x- and the y-axes, from each end of the cross bar. Each coupling flange may define a coupling hole (e.g., holes 131 and 133) for connecting to the coupling holes defined by the coupling flanges of the opposing apron assembly. For example, FIGS. 1A and 1B show opposing apron assemblies 107 and 109 connected via their respective coupling holes at connection points 135 and 137.

Each apron assembly may include an elbow flange (e.g., flange 139) that extends, along the x- and the y-axes, from the cross bar. The elbow flange may be a double flange that includes 2 adjacent flanges (e.g., flanges 141 and 143). The elbow flange may define a mounting hole (e.g., hole 145). In certain embodiments, the elbow flange (i.e., each adjacent flange) may include two sections. The two sections (e.g., sections 147 and 149) may be joined together at a joint (e.g., joint 151). The two sections may form an angle at the joint.

In some embodiments, the four perpendicular bars may be affixed to the cross bar with bolts (e.g., bolts 153, 155, 157, and 159). In certain embodiments, the apron assembly may be absent a welded joint. The apron assembly may also be absent another component of the apron assembly (apart from the cross bar) connecting any two of the four perpendicular bars.

The support mechanism may include a first leg assembly (e.g., leg assembly 161) that is affixed to each of the leg mounts of the first apron assembly. The support mechanism may also include a second leg assembly (e.g., leg assembly 163) that is affixed to each of the leg mounts of the second apron assembly.

The support mechanism may include a first folding arm (e.g., folding arm 165) that is affixed to the mounting hole of the first apron assembly and to the second leg assembly. The support mechanism may also include a second folding arm (e.g., folding arm 167) that is affixed to the mounting hole of the second apron assembly and to the first leg assembly.

In some embodiments, the support mechanism may include a third leg assembly (e.g., leg assembly 169) that is affixed to the first apron assembly. The support mechanism may also include a fourth leg assembly (e.g., leg assembly 171) that is affixed to the second apron assembly. The third and fourth leg assemblies may connect to the apron assemblies via another set of leg mounts (e.g., 124 and 126) included in the inner two perpendicular bars of each apron assembly. The first folding arm may also be affixed to the fourth leg assembly and the second folding arm may also be affixed to the third leg assembly. In some embodiments, the third and fourth leg assemblies may include latching mechanisms (e.g., mechanisms 170 and 172) for latching to each other when the table is folded. The latching may, in part or in whole, keep the table in the folded position.

In certain preferred embodiments, the distance in each apron assembly along the y-axis between the mounting hole and the coupling holes may be less than 40 millimeters. The distance in each apron assembly along the y-axis between the coupling holes and the leg mounts may be more than 69 millimeters. The distance in each apron assembly along the x-axis between the coupling holes and the leg mounts may be less than 120 millimeters.

In certain embodiments, the distance (e.g., distance 173) in each apron assembly along the y-axis between the mounting hole and the coupling holes may be substantially 35.5 millimeters. The distance (e.g., distance 175) in each apron assembly along the y-axis between the coupling holes and the leg mounts may be substantially 69.5 millimeters. The distance (e.g., distance 177) in each apron assembly along the x-axis between the coupling holes and the first leg mounts may be substantially 114.5 millimeters.

In some embodiments, the distance (e.g., distance 179) in each apron assembly along the x-axis between the first leg mounts and the second leg mounts may be substantially 479 millimeters. The distance (e.g., distance 181) in each apron assembly along the x-axis between the mounting hole and the coupling holes may be substantially 102 millimeters. The angle (e.g., angle 183) formed between the elbow flange and the coupling flange may be substantially 65 degrees. In some embodiments, distances 173-181 may be anywhere within 20 millimeters of the values recited in this application, and angle 183 may be within 10 degrees of 65.

In operation, application of a first force when the surface is in an unfolded position may convert the surface into a folded position. Application of a second force when the surface is in the folded position may convert the surface into the unfolded position. The forces may be applied to the surface. The forces may be applied to the table or tabletop. The forces may be applied to a seat. The forces may be applied to any suitable part of the table.

Figure 5B:
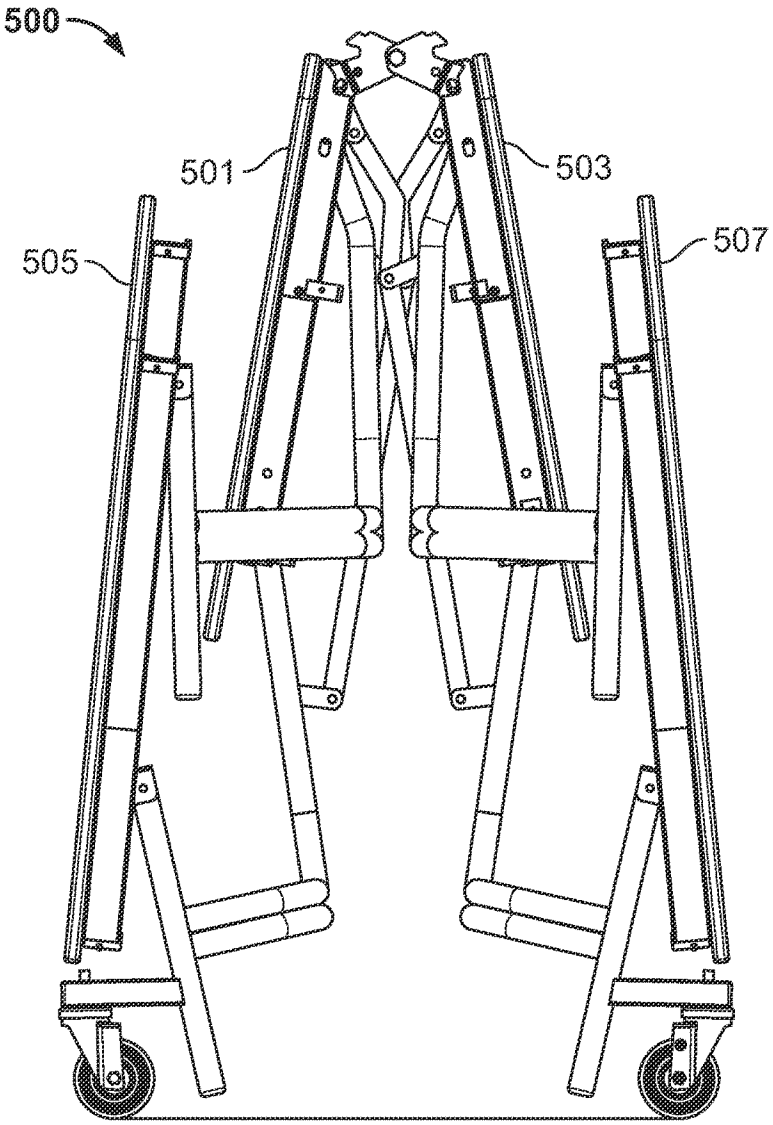
FIGS. 5A-5B show another illustrative apparatus in accordance with principles of the disclosure.
Figure 5A:
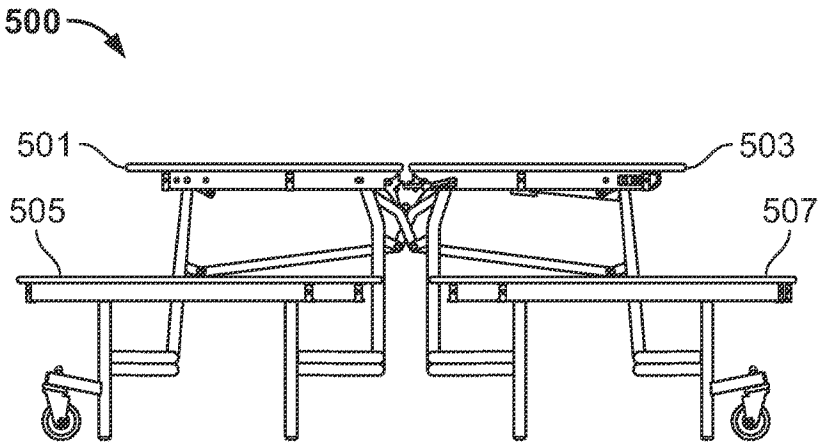

FIG. 5A shows illustrative table 500 in an unfolded position. FIG. 5B shows illustrative table 500 in a folded position. Table 500 may be substantially the same as table 100 shown in an unfolded position in FIGS. 1A and 1B. For the sake of clarity, some table components, such as latch mechanisms 170 and 172, may not be shown in table 500.

The first portion (e.g., portion 501) and the second portion (e.g., portion 503) of the surface may be separate from each other and oriented within 30 degrees of vertical when the surface is in the folded position.

In some embodiments, application of 30 pounds of force or less to the tabletop or seat may be sufficient to fold the table. In certain embodiments, application of 25 pounds of force to the table may be sufficient to fold the table. The force sufficient to fold the disclosed table may be less than a force that is sufficient to fold a conventional prior art folding table. The reduction in the force may be attributed, at least in part, to efficient dimensions of certain components of the table. The dimensions may provide, inter alia, leverage advantages over other conventional folding tables.

Certain embodiments may also include a plurality of seats (e.g., seats 505 and 507 of table 500). The seats may be connected to the leg assemblies. The seats may be horizontal when the surface is in the unfolded position. The seats may be within 30 degrees of vertical when the surface is in the folded position. In some embodiments, the seats may be within 10, 15, 20, 25, 35, 40, 45, 50, or other suitable number of degrees from vertical when in the folded position.

In some embodiments, the shape of the first portion of the surface (e.g., the tabletop), may mirror the shape of the second portion of the surface. For example, illustrative table 600 shown in FIGS. 6A and 6B includes first portion 601 that is a mirror image of second portion 603. As another example, illustrative table 700 shown in FIGS. 7A and 7B includes first portion 701 that is a mirror image of second portion 703.

The first portion and the second portion may form a unified, flat surface (e.g., surfaces 605 and 705) when the surface is in the unfolded position. The unified, flat surface may include a gap between the first and second portions.

Figure 6B:
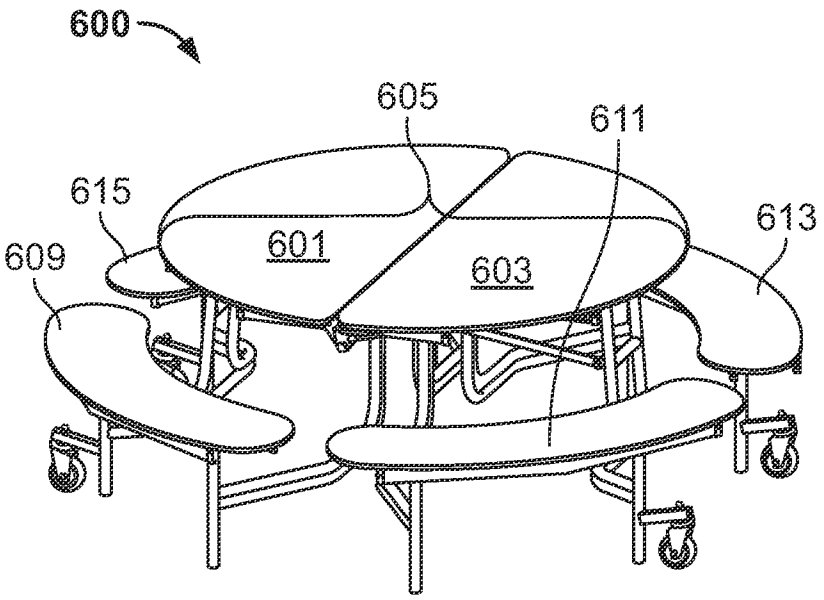
FIGS. 6A-6B show another illustrative apparatus in accordance with principles of the disclosure.
Figure 6A:
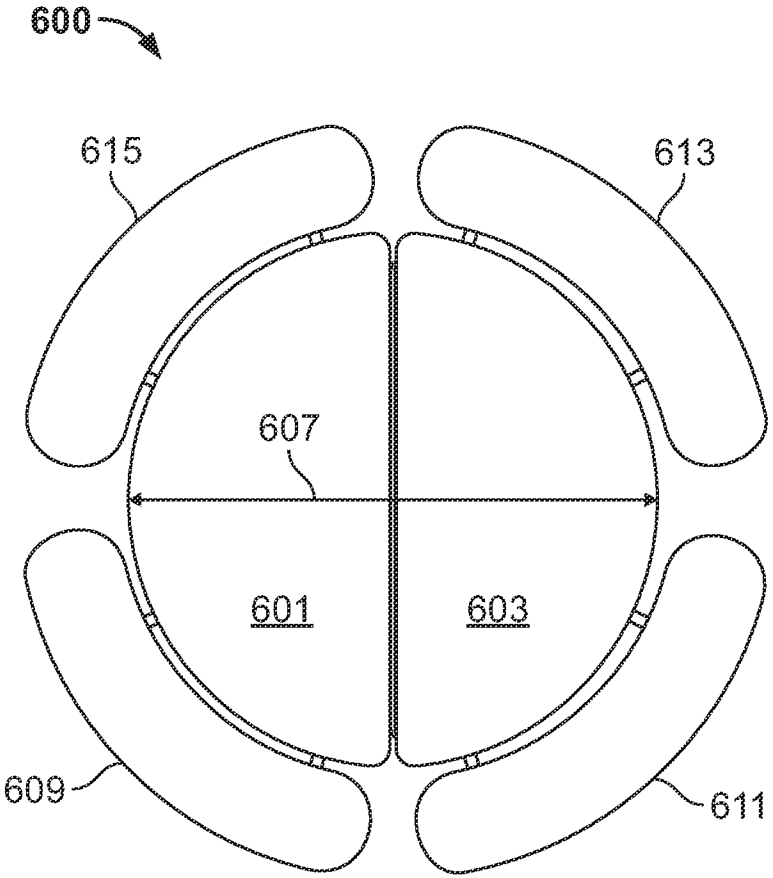
Figure 7B:
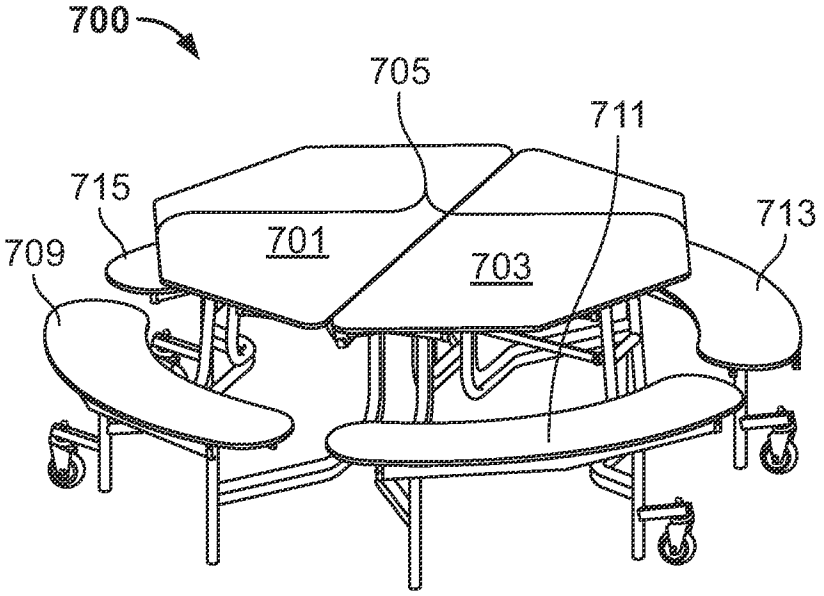
FIGS. 7A-7B show another illustrative apparatus in accordance with principles of the disclosure.
Figure 7A:
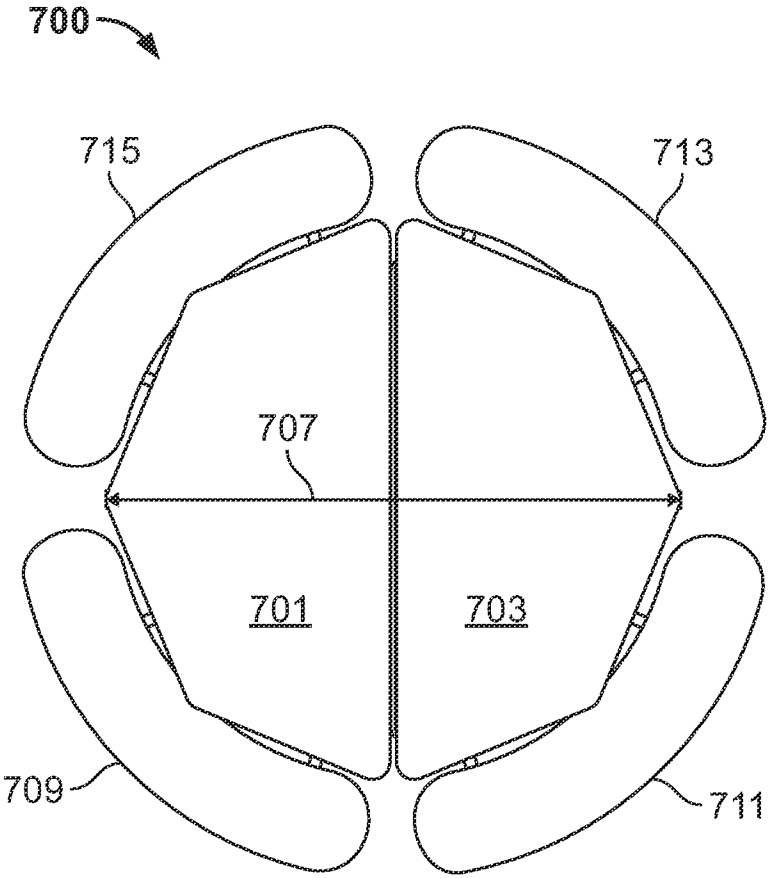
Figure 8B:
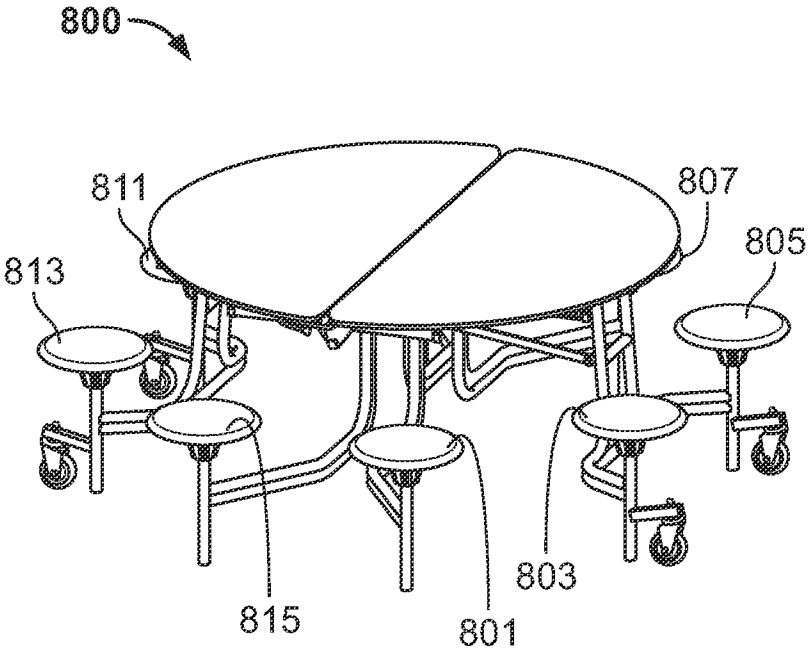
FIGS. 8A-8B show another illustrative apparatus in accordance with principles of the disclosure.
Figure 8A:
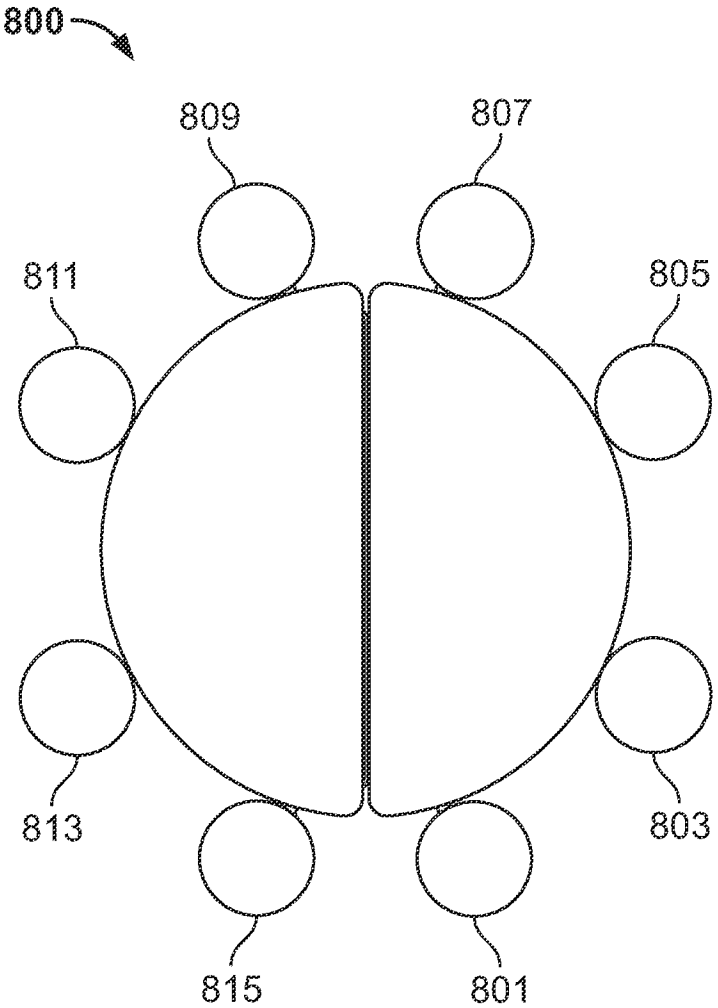

In certain embodiments, the unified, flat surface may form the shape of a circle (as shown for illustrative table 600 in FIGS. 6A and 6B and for table 800 in FIGS. 8A and 8B). In some embodiments, the unified, flat surface may form the shape of an octagon (as shown for illustrative table 700 in FIGS. 7A and 7B and for table 900 in FIGS. 9A and 9B). In other embodiments, the unified, flat surface may be a hexagon, any other polygon, or any other suitable shape.

In some embodiments, the diameter of the unified, flat surface (e.g., diameters 607 and 707) may be substantially 60 inches. The diameter of an octagonal surface may be an outer diameter, i.e., the diameter of a circle that circumscribes the octagon. In other embodiments, the diameter may be within 30 inches of 60, or any other suitable diameter.

In some embodiments, the leg assemblies may be configured to accommodate multiple configurations of the plurality of seats. One of the multiple configurations, shown in table 600 in FIGS. 6A and 6B and in table 700 in FIGS. 7A and 7B, may include four bench seats (e.g., benches 609, 611, 613, and 615 for table 600 and benches 709, 711, 713, and 715 for table 700). Two of the bench seats may be positioned proximal to the first portion of the tabletop and two of the bench seats may be positioned proximal to the second portion of the tabletop.

Another one of the multiple configurations, shown in table 800 in FIGS. 8A and 8B, may include eight stool seats (e.g., seats 801-815). Four of the stool seats may be positioned proximal to the first portion of the tabletop and four of the stool seats may be positioned proximal to the second portion of the tabletop.

Figure 9B:
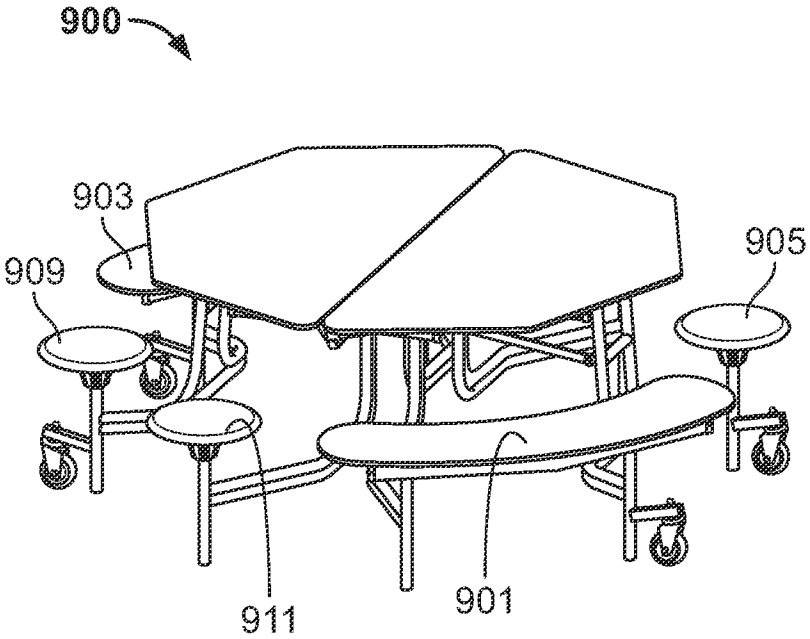
FIGS. 9A-9B show another illustrative apparatus in accordance with principles of the disclosure.
Figure 9A:
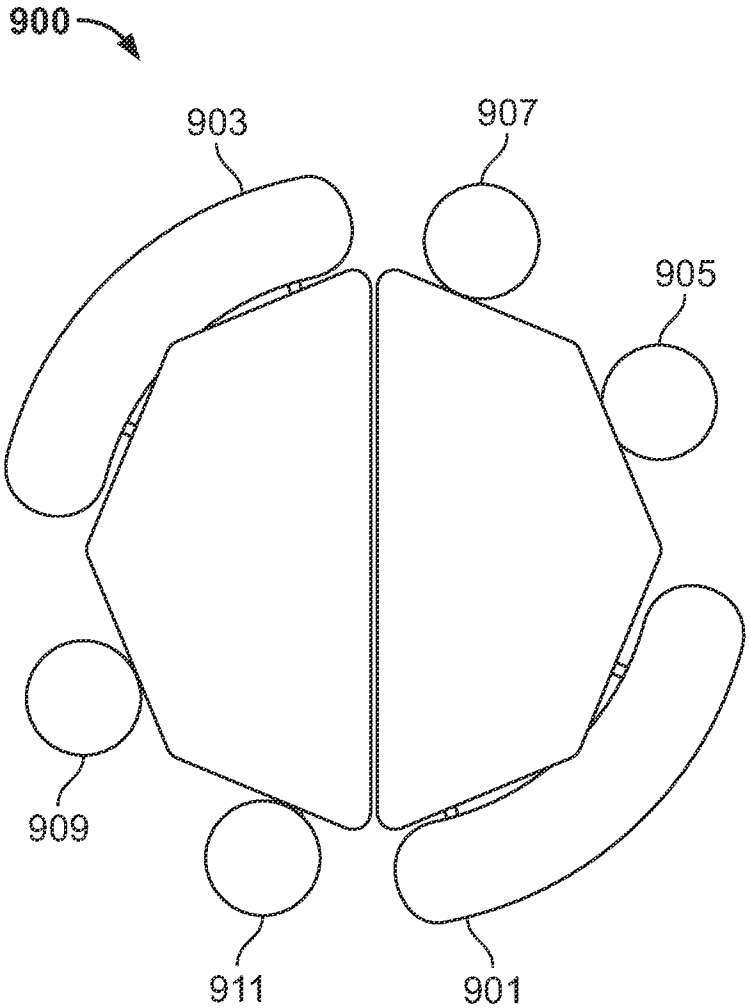

Yet another one of the multiple configurations, shown in table 900 in FIGS. 9A and 9B, may include two bench seats (e.g., benches 901 and 903) and four stool seats (e.g., seats 905-911). One of the bench seats and two of the stool seats may be positioned proximal to the first portion of the tabletop, and one of the bench seats and two of the stool seats may be positioned proximal to the second portion of the tabletop.

Figure 10:
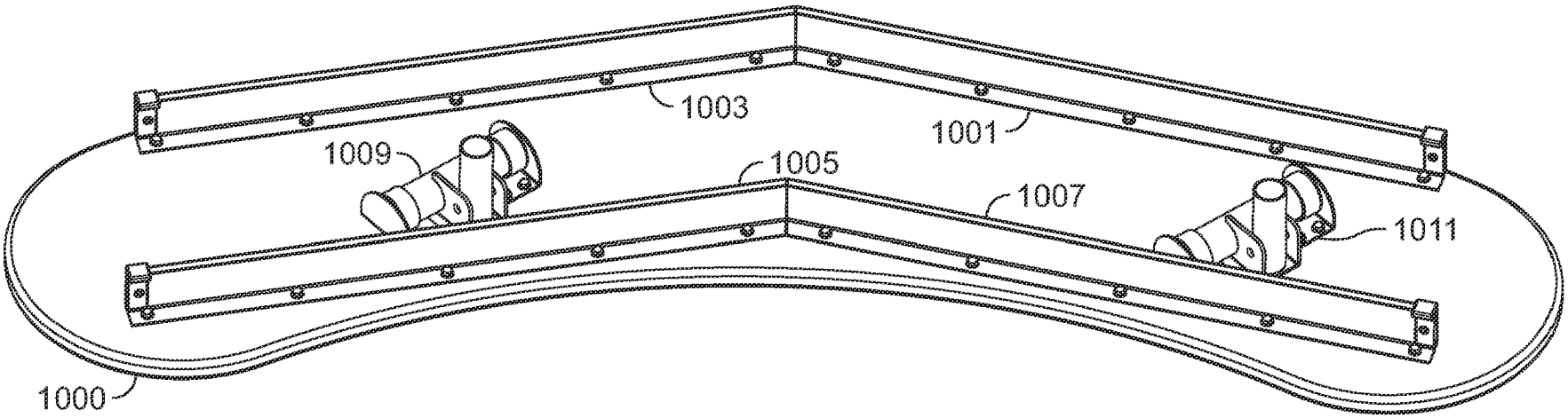
FIG. 10 shows another illustrative apparatus in accordance with principles of the disclosure.

FIG. 10 shows bench 1000 according to aspects of the disclosure. Bench 1000 may be similar to bench seats shown in tables 600, 700, and 900. Support bars 1001-1007 may be modular. The support bars may bolt into place and may not require or include any welded joints. Bench 1000 may also include mounts 1009 and 1011 for connecting to leg assemblies of a table.

The modular design of the support bars, the apron assembly, and other components of the disclosed folding table may provide structural advantages. The modular design may also provide efficiency advantages. Efficiency advantages may include reduced shipping size and/or weight. Efficiency advantages may also include reduced weight of the assembled table, and/or certain components thereof. Reduced weight may, in addition to being desirable itself, also allow for a reduced input force in folding and/or unfolding the table.

Methods for designing, rendering, and producing the disclosed apparatus are also disclosed. Designing and/or rendering the disclosed apparatus may include creating a digital image based on specification inputs. The specification inputs may include components and/or dimensions disclosed herein.

The steps of methods may be performed in an order other than the order shown and/or described herein. Embodiments may omit steps shown and/or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown and/or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

The drawings show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

One of ordinary skill in the art will appreciate that the steps shown and described herein may be performed in other than the recited order and that one or more steps illustrated may be optional. The methods of the above-referenced embodiments may involve the use of any suitable elements, steps, computer-executable instructions, or computer-readable data structures. In this regard, other embodiments are disclosed herein as well that can be partially or wholly implemented on a computer-readable medium, for example, by storing computer-executable instructions or modules or by utilizing computer-readable data structures. For example, methods for producing an apparatus may, in certain embodiments, be wholly or partially executed by designing the apparatus via software, such as computer aided design (CAD) software.

Thus, methods and systems for a folding table and associated folding mechanisms are provided. Persons skilled in the art will appreciate that the present invention can be practiced by other than the described embodiments, which are presented for purposes of illustration rather than of limitation, and that the present invention is limited only by the claims that follow.

What is claimed is:

1. A folding table, said table comprising:

a tabletop, the tabletop comprising a first portion and a second portion; and a support mechanism that supports the tabletop and facilitates folding of the table, the support mechanism comprising:

a first apron assembly affixed to a bottom surface of the first portion of the tabletop, and an opposing second apron assembly affixed to a bottom surface of the second portion of the tabletop, each apron assembly defining an x-axis, a y-axis, and a z-axis, each apron assembly comprising:

a cross bar disposed along the z-axis and four perpendicular bars disposed along the x-axis, wherein:

the four perpendicular bars are affixed directly to the cross bar and oriented substantially perpendicular to the cross bar;

the apron assembly is absent another fixed component directly connecting any two of the four perpendicular bars; and each of an inner two of the four perpendicular bars comprises an inward-facing leg mount;

a coupling flange that extends, along the x- and the y-axes, from each end of the cross bar, each coupling flange defining a coupling hole for connecting to the coupling holes defined by the coupling flanges of the opposing apron assembly; and an elbow flange that extends, along the x- and the y-axes, from the cross bar, the elbow flange defining a mounting hole;

a first leg assembly that is affixed to each of the leg mounts of the first apron assembly, and a second leg assembly that is affixed to each of the leg mounts of the second apron assembly; and a first folding arm that is affixed to the mounting hole of the first apron assembly and to the second leg assembly, and a second folding arm that is affixed to the mounting hole of the second apron assembly and to the first leg assembly;

wherein:

the distance in each apron assembly along the y-axis between the mounting hole and the coupling holes is less than 40 millimeters;

the distance in each apron assembly along the y-axis between the coupling holes and the leg mounts is more than 69 millimeters;

the distance in each apron assembly along the x-axis between the coupling holes and the leg mounts is less than 120 millimeters; and in operation, application of a first force to the table when the table is in an unfolded position converts the table into a folded position and application of a second force to the table when the table is in the folded position converts the table into the unfolded position.

2. The table of claim 1 wherein:

the shape of the first portion of the tabletop mirrors the shape of the second portion of the tabletop; and the first portion and the second portion:

are separate from each other and oriented within 30 degrees of vertical when the table is in the folded position; and form a unified, flat surface when the table is in the unfolded position.

3. The table of claim 2 wherein the unified, flat surface forms the shape of a circle or an octagon.

4. The table of claim 3 wherein the diameter of the unified, flat surface is substantially 60 inches.

5. The table of claim 1 wherein the inner two of the four perpendicular bars are a first length and the outer two of the four perpendicular bars are a second length, and the first length is longer than the second length.

6. The table of claim 5 wherein the first length is substantially 600 millimeters and the second length is substantially 300 millimeters.

7. The table of claim 1 further comprising:

a third leg assembly affixed to the first apron assembly; and a fourth leg assembly affixed to the second apron assembly;

wherein the first folding arm is also affixed to the fourth leg assembly and the second folding arm is also affixed to the third leg assembly.

8. The table of claim 1 further comprising a plurality of seats, wherein:

the seats are connected to the leg assemblies; and the seats are horizontal when the table is in the unfolded position.

9. The table of claim 8 wherein the leg assemblies are configured to accommodate multiple configurations of the plurality of seats, the multiple configurations comprising:

four bench seats, two of the bench seats positioned proximal to the first portion of the tabletop and two of the bench seats positioned proximal to the second portion of the tabletop, said bench seats that are oriented within 30 degrees of vertical when the table is in the folded position;

eight stool seats, four of the stool seats positioned proximal to the first portion of the tabletop and four of the stool seats positioned proximal to the second portion of the tabletop; and two bench seats and four stool seats, one of the bench seats and two of the stool seats positioned proximal to the first portion of the tabletop, and one of the bench seats and two of the stool seats positioned proximal to the second portion of the tabletop.

10. The table of claim 1 wherein the first force is less than 30 pounds.

11. The table of claim 1 wherein:

the four perpendicular bars are affixed to the cross bar with bolts; and the apron assembly is absent a welded joint.

12. The table of claim 1 wherein:

the distance in each apron assembly along the y-axis between the mounting hole and the coupling holes is substantially 35 millimeters;

the distance in each apron assembly along the y-axis between the coupling holes and the leg mounts is substantially 69.5 millimeters; and the distance in each apron assembly along the x-axis between the coupling holes and the leg mounts is substantially 114.5 millimeters.

13. The table of claim 1 wherein the elbow flange comprises two sections that are joined together at a joint, and the two sections form an angle at the joint.

14. A support mechanism for supporting a surface and facilitating folding of the surface, the surface comprising a first portion and a second portion, the support mechanism comprising:

a first apron assembly affixed to a bottom surface of the first portion of the surface, and an opposing second apron assembly affixed to a bottom surface of the second portion of the surface, each apron assembly defining an x-axis, a y-axis, and a z-axis, each apron assembly comprising:

a cross bar disposed along the z-axis and four perpendicular bars disposed along the x-axis, wherein:

the four perpendicular bars are affixed directly to the cross bar and oriented substantially perpendicular to the cross bar;

the apron assembly is absent another fixed component directly connecting any two of the four perpendicular bars; and each of an inner two of the four perpendicular bars comprises an inward-facing leg mount;

a coupling flange that extends, along the x- and the y-axes, from each end of the cross bar, each coupling flange defining a coupling hole for connecting to the coupling holes defined by the coupling flanges of the opposing apron assembly; and an elbow flange that extends, along the x- and the y-axes, from the cross bar, the elbow flange defining a mounting hole;

a first leg assembly that is affixed to each of the leg mounts of the first apron assembly, and a second leg assembly that is affixed to each of the leg mounts of the second apron assembly; and a first folding arm that is affixed to the mounting hole of the first apron assembly and to the second leg assembly, and a second folding arm that is affixed to the mounting hole of the second apron assembly and to the first leg assembly;

wherein:

the distance in each apron assembly along the y-axis between the mounting hole and the coupling holes is less than 40 millimeters;

the distance in each apron assembly along the y-axis between the coupling holes and the leg mounts is more than 69 millimeters;

the distance in each apron assembly along the x-axis between the coupling holes and the leg mounts is less than 120 millimeters; and in operation, application of a first force when the surface is in an unfolded position converts the surface into a folded position, and application of a second force when the surface is in the folded position converts the surface into the unfolded position.

15. The support mechanism of claim 14 further comprising:

a third leg assembly affixed to the first apron assembly; and a fourth leg assembly affixed to the second apron assembly;

wherein the first folding arm is also affixed to the fourth leg assembly and the second folding arm is also affixed to the third leg assembly.

16. The support mechanism of claim 15 further comprising a plurality of seats, wherein:

the seats are connected to the leg assemblies; and the seats are horizontal when the surface is in the unfolded position.

17. The support mechanism of claim 8 wherein the leg assemblies are configured to accommodate multiple configurations of the plurality of seats, the multiple configurations comprising:

four bench seats, two of the bench seats positioned proximal to the first portion of the surface and two of the bench seats positioned proximal to the second portion of the surface;

eight stool seats, four of the stool seats positioned proximal to the first portion of the surface and four of the stool seats positioned proximal to the second portion of the surface; and two bench seats and four stool seats, one of the bench seats and two of the stool seats positioned proximal to the first portion of the surface, and one of the bench seats and two of the stool seats positioned proximal to the second portion of the surface.

18. A modular apron assembly defining an x-axis, a y-axis, and a z-axis, the apron assembly comprising:

a cross bar disposed along the z-axis and four perpendicular bars disposed along the x-axis, wherein:

the four perpendicular bars are affixed directly to the cross bar and oriented substantially perpendicular to the cross bar;

the apron assembly is absent another fixed component directly connecting any two of the four perpendicular bars; and each of an inner two of the four perpendicular bars comprises an inward-facing leg mount;

a coupling flange that extends, along the x- and the y-axes, from each end of the cross bar, each coupling flange defining a coupling hole for connecting to the coupling holes defined by the coupling flanges of an opposing apron assembly; and an elbow flange that extends, along the x- and the y-axes, from the cross bar, the elbow flange defining a mounting hole;

wherein:

the distance along the y-axis between the mounting hole and the coupling holes is less than 40 millimeters;

the distance along the y-axis between the coupling holes and the leg mounts is more than 69 millimeters;

the distance along the x-axis between the coupling holes and the leg mounts is less than 120 millimeters;

the four perpendicular bars are affixed to the cross bar with bolts; and the apron assembly is absent a welded joint.

19. The apron assembly of claim 18 wherein the apron assembly is configured to:

be affixed to the bottom of a first portion of a two-part surface;

receive a leg assembly via the leg mounts; and receive a folding arm via the mounting hole, said folding arm that connects to a leg assembly that is affixed to the opposing apron assembly, said opposing apron assembly that is affixed to the bottom of a second portion of the two-part surface.

20. The apron assembly of claim 18 wherein:

the distance along the y-axis between the mounting hole and the coupling holes is substantially 35 millimeters;

the distance along the y-axis between the coupling holes and the leg mounts is substantially 69.5 millimeters;

the distance along the x-axis between the coupling holes and the leg mounts is substantially 114.5 millimeters; and the elbow flange comprises two sections that are joined together at a joint, and the two sections form an angle at the joint.

* * * * *